United States Patent [19]

Millar et al.

[11] 4,083,194

[45] Apr. 11, 1978

[54] PROCESS FOR RECOVERY OF LIQUID HYDROCARBONS

[75] Inventors: James F. Millar, Lilydale; John E. Cockshott, Middle Brighton, both of Australia

[73] Assignee: Fluor Engineers and Constructors, Inc., Los Angeles, Calif.

[21] Appl. No.: 746,839

[22] Filed: Dec. 2, 1976

[51] Int. Cl.[2] ..... F25B 15/00

[52] U.S. Cl. ..... 62/101

[58] Field of Search ..... 62/20, 54, 101

[56] References Cited

U.S. PATENT DOCUMENTS

| | | | |
|---|---|---|---|
| 2,650,480 | 9/1953 | Gilmore | 62/101 |
| 3,271,965 | 9/1966 | Maher et al. | 62/54 |
| 3,271,967 | 9/1966 | Karbosky | 62/54 |
| 3,292,380 | 12/1966 | Bucklin | 62/20 |
| 3,327,490 | 6/1967 | Grenier | 62/54 |
| 3,817,050 | 6/1974 | Alexander et al. | 62/101 |
| 3,854,301 | 12/1974 | Cytryn | 62/101 |

*Primary Examiner*—Lloyd L. King
*Attorney, Agent, or Firm*—Lyon & Lyon

[57] ABSTRACT

Methane is recovered as a gas for discharge to a pipeline from a gas stream containing methane and heavier hydrocarbons, principally ethane and propane. Separation is accomplished by condensing the heavier hydrocarbons and distilling the methane therefrom. A liquid product (LPG) comprising the heavier hydrocarbons is subsequently recovered and transferred to storage. Prior to being discharged to a pipeline, the recovered methane gas is compressed and in undergoing compression the gas is heated. The heat content of the gas is employed to reboil the refrigerant in an absorption refrigeration unit. The refrigeration unit is used to cool the LPG prior to its storage.

10 Claims, 1 Drawing Figure

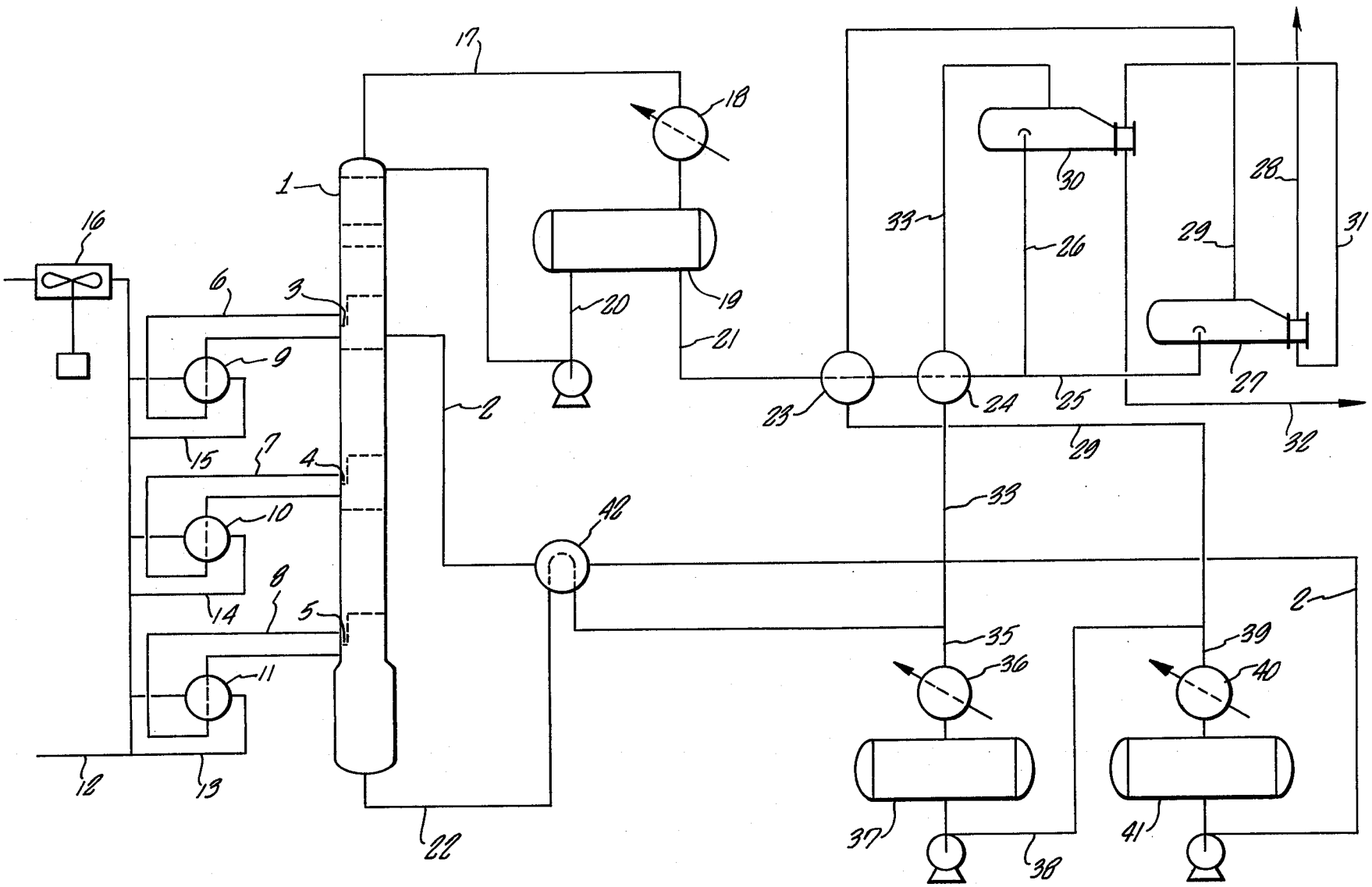
1
2
3
4
5
6
7
8
9
10
11
12
13
14
15
16
17
18
19
20
21
22
23
24
25
26
27
28
29
30
31
32
33
34
35
36
37
38
39
40
41
42

PROCESS FOR RECOVERY OF LIQUID HYDROCARBONS

FIELD OF THE INVENTION

This invention relates to a process for recovering methane from a stream containing methane and heavier hydrocarbons. More specifically, it relates to a process whereby the gas stream is cooled to condense the heavier hydrocarbons from which the methane is separated as a gas by distillation.

BACKGROUND OF THE INVENTION

Gaseous streams comprising methane and heavier hydrocarbons occur naturally, i.e., as natural gas, or are an important by-product of a variety of refinery processes. It is often desired to recover the methane from such streams for such use as a fuel or as a reactant. One method for recovering methane particularly suited for treatment of natural gas streams involves cooling the stream to condense the heavier hydrocarbons from which the methane can be separated by distillation. The distillation is usually accomplished on a stream precooled to at least about −100° F.

A specific process for obtaining methane from natural gas involving distillation of methane from condensed heavier hydrocarbons is described in detail in U.S. Pat. No. 3,292,380, the disclosure of which is incorporated herein by reference. In that process, the gas stream under high pressure is first cooled in a first stage by indirect heat exchange to about 32° F or below. The gas is then expanded through a turbine to cool it to below about −100° F thereby obtaining a condensate comprising the heavier hydrocarbons. The methane in the stream is removed as overhead from a stripping column. The heavier hydrocarbons are recovered from the stripper and may require further processing to produce a liquified product (LPG). The LPG is subsequently cooled and transported to storage.

In this and related processes, the methane is recovered at too low a pressure for economical transportation by pipeline. As a result, it must be compressed before being discharged through the pipeline. As a result of this compression, typically to about 500 p.s.i.g. or greater, the methane is heated, usually to at least 170° F and sometimes as high as 400° F. In the processes known to the prior art, the heat content of the compressed gas is usually wasted as the temperature at which it is available is typically regarded as being too low for efficient recovery.

By contrast, the LPG product is usually obtained at a temperature higher than that at which storage is convenient. Therefore, prior to storage the LPG is cooled, preferably to about 45° F or lower. In the past, cooling of the LPG has usually been accomplished by using conventional compression refrigeration means. Fuel for the refrigeration compressor has been obtained by diverting a portion of the methane gas obtained as product. Typically a gas engine or turbine is used to drive the compressor.

The recent escalation of fuel costs has made the prior art process less attractive inasmuch as it consumes a portion of the relatively expensive methane product. Therefore, it should be apparent from the foregoing that a process avoiding the consumption of a portion of the methane product would constitute a valuable advance in the art. Accordingly, one object of this invention is to provide an improved process for separating methane from heavier hydrocarbons by distillation.

Another object of this invention is to provide a process for separating methane and LPG fractions from a stream of gaseous hydrocarbons whereby it is not required to consume any of the methane produced as fuel for condensing and subcooling LPG produced in the process. Yet another object of this invention is to provide an improved process involving the distillation of methane from condensed heavier hydrocarbons whereby the heat content of a compressed methane gas product is efficiently recovered.

The manner is which these and other objects may be attained will be apparent from a consideration of the following description of the invention.

SUMMARY OF THE INVENTION

Compressed methane gas obtained as distillate from a gas stream comprising methane and heavier hydrocarbons that has been cooled to condense the heavier hydrocarbons, is passed in indirect heat exchange with the feed to a regeneration column in an absorption refrigeration unit in order to reboil the refrigerant from the absorbant. The reboiled refrigerant is condensed and subsequently expanded to cool it to the desired temperature and passed in indirect heat exchange with a liquid product (LPG), comprised of heavier hydrocarbons from which the methane has been distilled, to cool the LPG sufficiently to allow its storage. The refrigerant is subsequently absorbed by the absorbant and returned to the regeneration column as a feed stream. The preferred absorption refrigeration unit employs ammonia as a refrigerant and water as the absorbant.

BRIEF DESCRIPTION OF THE DRAWING

The FIGURE is schematic diagram of a process according to the present invention.

DETAILED DESCRIPTION OF THE INVENTION

The present invention is described below in terms of the presently preferred embodiments with reference to the FIGURE which schematically represents an absorption refrigeration unit. The unit is used to cool the liquified product (LPG) comprised of the heavier hydrocarbons, largely ethane and propane, obtained from a gas stream comprising methane and heavier hydrocarbons. As previously described, the gas stream is cooled to condense the heavier hydrocarbons from which the methane is separated by distillation. The presently preferred process for obtaining the LPG product used in this invention is that described in the aforementioned U.S. Pat. No. 3,292,380.

Absorption refrigeration units and the manner of their operation are generally well known to those skilled in the art. Any suitable type may be used. The working fluid in an absorption refrigeration system generally comprises a refirgerant and an absorbant or solvent for the refrigerant. There are many suitable refrigerant-absorbant combinations known to those in the art among which may be mentioned the system in which water is used as the refrigerant and a solution of lithium bromide and water functions as the solvent. A more widely used combination, and the one preferred for use in this invention, employs ammonia as the refrigerant and a dilute solution of ammonia and water as the solvent. The process described hereinafter employs such a combination.

In an absorption refrigeration system, the refrigerant is passed in indirect heat exchange with the substance being cooled which, in accordance with the present invention, is an LPG product obtained from a stream of hydrocarbons in the manner previously discussed. The refirgerant is then absorbed in the appropriate solvent and the resulting solution transferred to a regeneration unit where the solution is reboiled to distill the refrigerant from the solution. In accordance with the present invention, the source of heat for the regeneration of the refrigerant is derived from the stream of methane gas recovered from the heavier hydrocarbons.

In the distillation of the methane from the condensed hydrocarbons the methane is taken as overhead from the distillation column and subsequently compressed to a pressure suitable for introduction to a pipeline using conventional compressor equipment. Usually the methane is compressed to a pressure of about 500–1500 p.s.i.a. As a result of this compression, the gaseous methane is heated to a temperature from about 170° F–400° F. Preferably the gas employed is heated by compression to a temperature of at least about 200° F.

Turning now to the FIGURE, a specific application of the present invention will be described. In the FIGURE there is shown a regeneration column 1 to which is continuously fed a solution of ammonia (55% by weight) and water (45% by weight) through line 2 at 152° F and 285 p.s.i.a. the solution travels downwardly in column 1 with portions being accumulated in downcomers 3, 4 and 5 for removal from column 1 through line 6, 7 and 8 and passage through reboilers 9, 10 and 11 which can be conventional heat exchange equipment.

Heat for the reboilers is provided by indirect heat-exchange with a compress methane gas stream introduced to the refrigeration unit through line 12 at a temperature of 283° F at about 1000 p.s.i.a. At least a portion of this stream is diverted into line 13 and through reboiler 11. The solution in line 8 is withdrawn from the regeneration column at 206° F through line 8 and is returned to the column after passage through reboiler 11 at 240° F. In its passage through the reboiler, the diverted portions of the methane stream is cooled to about 240° F.

A portion of the gas stream at about 243° F is also diverted from line 12 into line 14 and through reboiler 10 for indirect heat exchange with the solution withdrawn from column 2 through line 7. Solution in line 7 is withdrawn at about 173° F and returned to the column at 202° F after passage through reboiler 10. In this process, the diverted portion of the methane stream is cooled to about 202° F.

Finally, a portion of the gas stream is diverted from line 12 into line 15 and through reboiler 9 at 207° F. In reboiler 9, it heats the solution withdrawn from column 2 through line 6 from 154° F to 168° F at which temperature it is returned to the column. The methane in line 15 is returned to line 12 at 168° F.

After recombination with the portion of methane diverted through line 15, the gas in line 12, at about 174° F, is further cooled by means of a fin-fan cooler 16, or other suitable means, to about 120° F and discharged to a pipeline (not shown).

Although the use of the methane stream to supply heat to regeneration column 1 is shown as being employed in 3 different reboilers, it will be appreciated by those skilled in the art that fewer or more than 3 reboilers can be employed.

Ammonia (99.9%) is recovered for use as the refrigerant as overhead from column 1 through line 17 at 96.5° F and 200 p.s.i.a. The recovered ammonia is condensed in heat exchanger 18 and accumulated in vessel 19 at 185 p.s.i.g. at 96° F. A portion of the condensed ammonia may be returned through line 20 to column 1 as reflux. The remainder of the ammonia in vessel 19 is removed through line 21 for use as a refrigerator. A bottoms product comprising a dilute solution of ammonia (30% by weight) in water (70% by weight) is removed from column 1 through line 22 for use as the absorbant for the ammonia refrigerant.

The ammonia in line 21 is cooled to 77° F in two stages by passage through heat exchangers 23 and 24 after which it is split into two lines 25 and 26. The ammonia in line 25 is expansively cooled by being flashed to a pressure of 85 p.s.i.g. in refrigerated exchanger 27. The cooled refrigerant absorbs heat by indirect heat exchange from LPG product admitted to exchanger 27 through line 28 at 106° F from a source not shown. The LPG is cooled from 106° F to about 71° F in this way. The refrigerant exits the exchanger 27 at 61° F and is transmitted through line 29 to exchanger 23 where it is used to cool the refrigerant from vessel 19 from 96° F to 86° F by indirect heat exchange.

The refrigerant in line 26 is expansively cooled by being flashed to a pressure of 45 p.s.i.g. in refrigerated exchanger 30. The cooled refrigerant absorbs heat by indirect heat exchange with LPG transported from exchanger 27 through line 31 thereby cooling it from about 71° F to about 45° F. The cooled LPG is then transported to storage facilities (not shown) through line 32. Although the LPG has been described as being cooled in two separate stages, it will be appreciated by those skilled in the art that by appropriate modification of this process the cooling may be accomplished in a single stage or using three or more stages. Although the expansive cooling of the refrigerant has been disclosed as being effected with exchangers 27 and 30 in a parallel arrangement, it will be appreciated by those skilled in the art that, by appropriate modification of this process, the expansive cooling can be effected with exchangers 27 and 30 connected in a series arrangement.

The refrigerant exits exchanger 30 at 35° F through line 33 for transport to exchanger 24 where it further cools by indirect heat exchange the refrigerant in line 21 as has previously been described.

The refrigerant in line 33 after passage through exchanger 24 is combined with the dilute ammonia-water absorbant solution in line 22 and the combined streams transported in line 35 through cooler 36 into accumulator vessel 37 where the enriched solution of absorbed ammonia (43% by weight ammonia) is maintained at 35 p.s.i.g. and 102° F.

The solution in accumulator 37 is pumped through line 38 for combination with refrigerant from exchanger 23 in line 29. The combined streams are conducted through line 39 and cooler 40 into accumulator 41 where the further enriched solution of ammonia (55% by weight ammonia) is maintained at 75 p.s.i.g. and 102° F. The solution in accumulator 41 comprises the feed to column 1 from which the ammonia is regenerated. Prior to its admission to column 1, the ammonia solution is pumped from accumulator 41 through exchanger 42 in an indirect heat exchange relationship with the bottoms product in line 22. In this way, the bottoms product is lowered in temperature to about 163° F from about 240° F whereas the temperature of the feed stream in line 2 is raised to about 152° F prior to its admission to column 1.

Employing this process, 19.3 million BTU's of refrigeration were obtained without expenditure of fuel from a regeneration column feed comprising 49,158 pounds per hour of water and 60,082 pounds per hour of ammonia. The capital cost of this equipment used in this process is generally less than that for conventional compression refrigeration equipment.

The foregoing description has been directed to a presently preferred embodiment of the present invention. It will be appreciated by those skilled in the art that variations in the process actually described can be made without departing from the scope of the invention.

We claim:

1. In a process for separating a stream of methane gas from liquified heavier hydrocarbons in which the methane is compressed after separation thereby heating the methane stream, the improvement comprising:

(a) passing the methane gas in indirect heat exchange with a solution comprising a refrigerant in a suitable solvent to distill said refrigerant from the solvent;

(b) condensing the distilled refrigerant;

(c) expansively cooling the condensed refrigerant;

(d) passing the cooled refrigerant in a heat exchange relationship with the liquified hydrocarbons to cool said hydrocarbons; and (e) absorbing the refrigerant in said solvent.

2. A process according to claim 1 wherein the refrigerant is water and the solvent is a solution of lithium bromide in water.

3. A process according to claim 1 wherein the refrigerant is ammonia and the solvent is a solution of ammonia in water.

4. a process according to claim 1 wherein the methane is heated by said compression to at least about 170° F.

5. A process according to claim 4 wherein the methane is heated to at least about 200° F.

6. A process according to claim 3 wherein the refrigerant is removed from said distillation as overhead from a refrigerant regeneration column and the solvent removed as a bottom product.

7. A process according to claim 6 wherein a portion of the condensed ammonia is returned to the regeneration column as reflux.

8. A process according to claim 3 wherein the liquified hydrocarbons are cooled in two stages.

9. A process according to claim 3 wherein portions of the solution of ammonia refrigerant in the ammonia-water solvent are withdrawn from said regeneration column and passed in indirect heat exchange with said methane and returned to said regeneration column.

10. A process according to claim 3 wherein the refrigerant is separated into two portions prior to said expansive cooling.

* * * * *